US007786967B2

(12) United States Patent
Kim et al.

(10) Patent No.: US 7,786,967 B2
(45) **Date of Patent: *Aug. 31, 2010**

(54) APPARATUS AND METHOD FOR DRIVING LIQUID CRYSTAL DISPLAY DEVICE

(75) Inventors: Seong Gyun Kim, Gyeonggi-do (KR); Nam Yong Kong, Gyeonggi-do (KR); Seung Chan Byun, Incheon-si (KR)

(73) Assignee: LG. Display Co., Ltd., Seoul (KR)

( * ) Notice: Subject to any disclaimer, the term of this patent is extended or adjusted under 35 U.S.C. 154(b) by 1094 days.

This patent is subject to a terminal disclaimer.

(21) Appl. No.: 11/476,303

(22) Filed: Jun. 27, 2006

(65) Prior Publication Data

US 2007/0097058 A1 May 3, 2007

(30) Foreign Application Priority Data

Oct. 20, 2005 (KR) ..... 10-2005-0099262

(51) Int. Cl.
*G09G 3/36* (2006.01)

(52) U.S. Cl. ..... 345/89; 345/99

(58) Field of Classification Search ..... 345/87, 345/89, 98–100, 690–693
See application file for complete search history.

(56) References Cited

U.S. PATENT DOCUMENTS

| | | | | |
|---|---|---|---|---|
| 6,556,180 | B1 * | 4/2003 | Furuhashi et al. | 345/87 |
| 7,400,311 | B2 * | 7/2008 | Park et al. | 345/87 |
| 2005/0052386 | A1 * | 3/2005 | Kwon et al. | 345/87 |
| 2006/0072031 | A1 * | 4/2006 | Min | 348/362 |
| 2006/0274335 | A1 * | 12/2006 | Wittenstein | 358/1.9 |
| 2007/0001933 | A1 * | 1/2007 | Suzuki et al. | 345/63 |
| 2007/0152934 | A1 * | 7/2007 | Maeda | 345/92 |

FOREIGN PATENT DOCUMENTS

| | | |
|---|---|---|
| JP | 57-94267 | 6/1982 |
| JP | 05-022633 | 1/1993 |
| JP | 07-199856 | 8/1995 |
| JP | 2003-050574 | 2/2003 |
| JP | 2003-345285 | 12/2003 |
| JP | 2005-043864 | 2/2005 |
| JP | 2005-527163 | 9/2005 |
| WO | 02/104005 A1 | 12/2002 |

OTHER PUBLICATIONS

Office Action issued in corresponding Japanese Patent Application No. 2006-176597; issued Jan. 6, 2010.

* cited by examiner

*Primary Examiner*—Ricardo L Osorio
(74) *Attorney, Agent, or Firm*—Brinks Hofer Gilson & Lione

(57) ABSTRACT

An apparatus and a method that drives an LCD device is provided. The apparatus that drives an LCD device includes an image display unit that includes liquid crystal cells that are formed in areas defined by a plurality of gate lines and a plurality of data lines. A data driver provides analog video signals to the data lines. A gate driver provides scan pulses to the gate lines. A data converter determines still images and moving images between adjacent frames of input data and generates modulated data that generates only undershoot at a boundary part of the still images and the moving images. A timing controller arranges the modulated data and provides it to the data driver.

29 Claims, 17 Drawing Sheets

APPARATUS AND METHOD FOR DRIVING LIQUID CRYSTAL DISPLAY DEVICE

This application claims the benefit of the Korean Patent Application No. 2005-0099262, filed on Oct. 20, 2005, which is hereby incorporated by reference as if fully set forth herein.

BACKGROUND

1. Field

An apparatus and a method that drives an LCD device are provided.

2. Related Art

Generally, liquid crystal display (LCD) devices adjust light transmittance of liquid crystal cells to display images, according to video signals. An LCD device of an active matrix type with switching elements that are formed in each liquid crystal cell, are widely used to display images thereon. The active matrix type LCD device mainly employs thin film transistors (TFT) as the switching elements.

FIG. 1 illustrates a schematic block diagram of an apparatus that drives an LCD device according to the related art.

Referring to FIG. 1, the related art LCD driving apparatus includes an image display unit 2 that includes liquid crystal cells that are formed at respective areas defined by n-th gate lines GL1 to GLn and m-th data lines DL1 to DLm. A data driver 4 provides analog video signals to the data lines DL1 to DLm. A gate driver 6 provides scan pulses to the gate lines GL1 to GLn. A timing controller 8 arranges data RGB inputted from the outside and provides it to the data driver 4 to generate data control signals DCS to control the data driver 4 and generate gate control signals GCS that control the gate driver 6.

The image display unit 2 includes a transistor array substrate and a color filter array substrate, which are bound with each other in a state where they face one another. Spacers are located between two array substrates to maintain the cell gap therebetween. The liquid crystal is filled in the space formed by the spacers between the two array substrates.

The image display unit 2 includes TFTs that are formed in areas that are defined by n-th gate liens GL1 to GLn and m-th data lines DL1 to DLm, and the liquid crystal cells connected to the TFTs. The TFTs respond to scan pulses from the gate lines GL1 to GLn and provide analog video signals from the data lines DL1 to DLm to the liquid crystal cells. The liquid crystal cells are composed of a common electrode and pixel electrodes connected to the TFTs, in which the common electrode and the pixel electrode face one another with respect to a liquid crystal layer. Therefore, the liquid crystal cells can be described as a liquid crystal capacitor Clc in an equivalent circuit. Such a liquid crystal cell includes a storage capacitor Cst that is connected to a previous stage gate line in order to maintain an analog video signal that is charged in a liquid crystal capacitor Clc until the next analog video signals are charged therein.

The timing controller 8 arranges the data RGB inputted from the outside to comply with the driver of the image display unit 2 and then provides it to the data driver 4. The timing controller 8 generates a data control signal DCS and a gate control signal GCS, using a dot clock DCLK, a data enable signal DE, and horizontal and vertical synchronous signals Hsync and Vsync. The data control signal DCS and a gate control signal GCS are used to control driving timings of the data driver 4 and the gate driver 6, respectively.

The gate driver 6 includes shift registers that sequentially generate scan pulses, or gate high pulses, in response to a gate start pulse GSP and a gate shift clock GSC in the gate control signal GCS from the timing controller 8. Such a gate driver 6 sequentially provides gate high pulses to the gate lines GL of the image display 2 to turn on the TFTs connected to the gate lines GL.

The data driver 4 converts an arranged data signal Data to an analog video signal. The arranged data signal Data is outputted from the timing controller 8 according to the data control signal DCS that is provided from the timing controller 8. The data driver 4 provides analog video signals that correspond to one horizontal line to the data lines DL each time a scan pulse is provided thereto, or each one horizontal period. The data driver 4 selects a gamma voltage that has a certain level according to gray levels of the data signal Data, and then provides the selected gamma voltage to the data lines DL1 to DLm. The data driver 4 reverses the polarity of the analog video signal, which is provided to the data lines DL in response to a polarity control signal POL.

The related art LCD driving apparatus's response speed is slow because of characteristics such as inherent viscosity and elasticity of liquid crystal. Although the liquid crystal response speed depends on, for example, physical properties of liquid crystal material and a cell gap, generally, the rising time of liquid crystal is 20~80 ms and falling time of liquid crystal is 20~30 ms. Because this response speed is longer than one frame period (16.67 ms in National Television Standards Committee (NTSC)) of a moving image, as shown in FIG. 2, the response of the liquid crystal proceeds to the next frame before a voltage being charged on the liquid crystal cell reaches a desired level.

Since a present frame for images, which are presently displayed on the image display unit, affects a next frame, a motion blurring phenomenon appears on the images displayed on the image display unit, as shown in FIG. 3. The motion blurring phenomenon means that moving images are blurry when displayed on the image display unit according to perception characteristics of viewers.

Therefore, the related art LCD driving apparatus and method have a decreased contrast ratio and thus image quality deteriorates, due to a motion blurring phenomenon generated in the displayed images.

In order to prevent such a motion blurring phenomenon in the relate art LCD device, an over-driving apparatus, which can modulate data signals for enhancing a liquid crystal response speed, is proposed.

FIG. 4 illustrates a block diagram of an over-driving apparatus according to the related art.

Referring to FIG. 4, the related art over-driving apparatus 50 includes a frame memory that stores data RGB of an inputted present frame Fn, a look up table that compares the data RGB of the inputted present frame Fn with data of a previous frame Fn−1 stored in the frame memory and that generates modulated data for enhancing liquid crystal response speed, and a mixer that mixes the modulated data from the look up table with the data RGB of the present frame Fn to output the mixing result thereto.

The look up table 54 records modulated data to be converted to a voltage greater than that of the data RGB of the present frame Fn in order to enhance the liquid crystal response speed, in which the voltage corresponds to a gray level of rapidly changed images.

Since the related art over-driving apparatus applies a voltage greater than that of a real data to a liquid crystal layer, using the look up table, as shown in FIG. 5, the liquid crystal in the liquid crystal layer can rapidly respond to comply with an objective gray level voltage. When the voltage reaches to the actual desired gray level, the gray level is maintained.

The related art over-driving apparatus enhances the liquid crystal response speed using a modulated data R'G'B', such that a motion blurring phenomenon of displayed images can be reduced.

When the related art LCD device displays images using the over-driving apparatus, the displayed images are not clear due to a motion blurring phenomenon which occurs at the boundary parts A and B of each displayed image, as shown in FIG. 6. In other words, since luminance increases between the boundaries A and B of the image to have a tilt, motion blurring still occurs even though the liquid crystal is driven at high speed.

SUMMARY

An apparatus and method that drives an LCD device is provided.

An apparatus that drives an LCD device comprises an image display unit that includes LC cells that are formed in areas defined by a plurality of gate lines and a plurality of data lines. A data driver provides analog video signals to the data lines. A gate driver provides scan pulses to the gate lines. A data converter determines still images and moving images between adjacent frames of input data and generates modulated data that generates only undershoot at a boundary that is part of the still images and the moving images. A timing controller arranges the modulated data to provide it to the data driver and drives the data driver and the gate driver.

A method for driving an LCD device with an image display unit that includes liquid crystal cells that are formed areas that are defined by a plurality of gate lines and a plurality of data lines. The method comprises the steps of determining still images and moving images between adjacent frames of input data, and generating modulated data which generates only undershoot in a boundary part of the still images and the moving images; providing scan pulses to the respective gate lines; and converting the modulated data to analog video signals such that the signals are synchronized with the scan pulses, and providing the signals to the respective data lines.

It is to be understood that both the foregoing general description and the following detailed description are exemplary and explanatory and are only intended to provide further explanation of the embodiments as claimed.

DRAWINGS

The accompanying drawings, which are included to provide a further understanding of the embodiments and are incorporated in and constitute a part of this application. In the drawings.

DESCRIPTION

Figure 1:
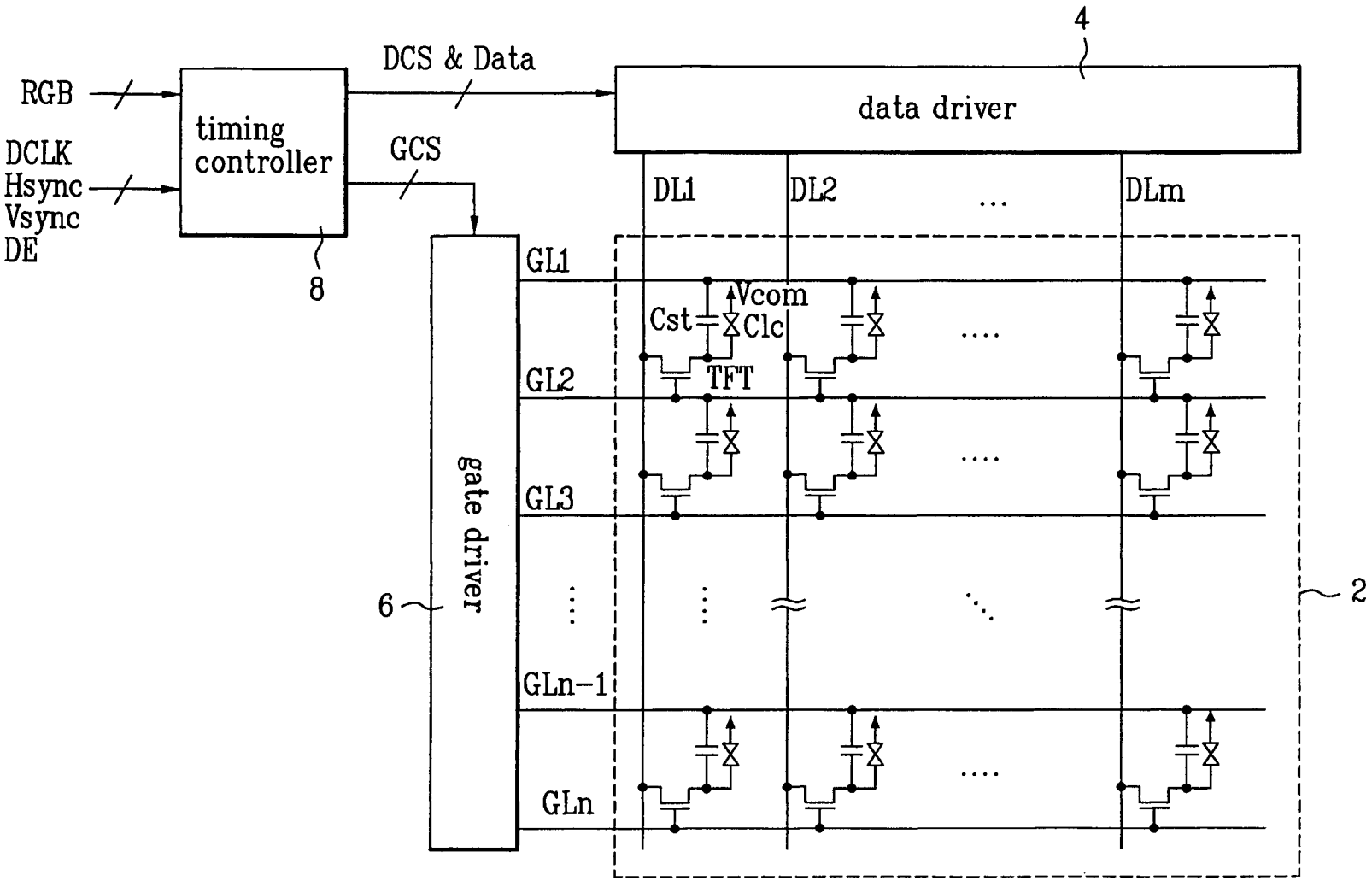
FIG. 1 Related Art
FIG. 1 is a block diagram of an apparatus for driving an LCD device according to the related art.
Figure 2:
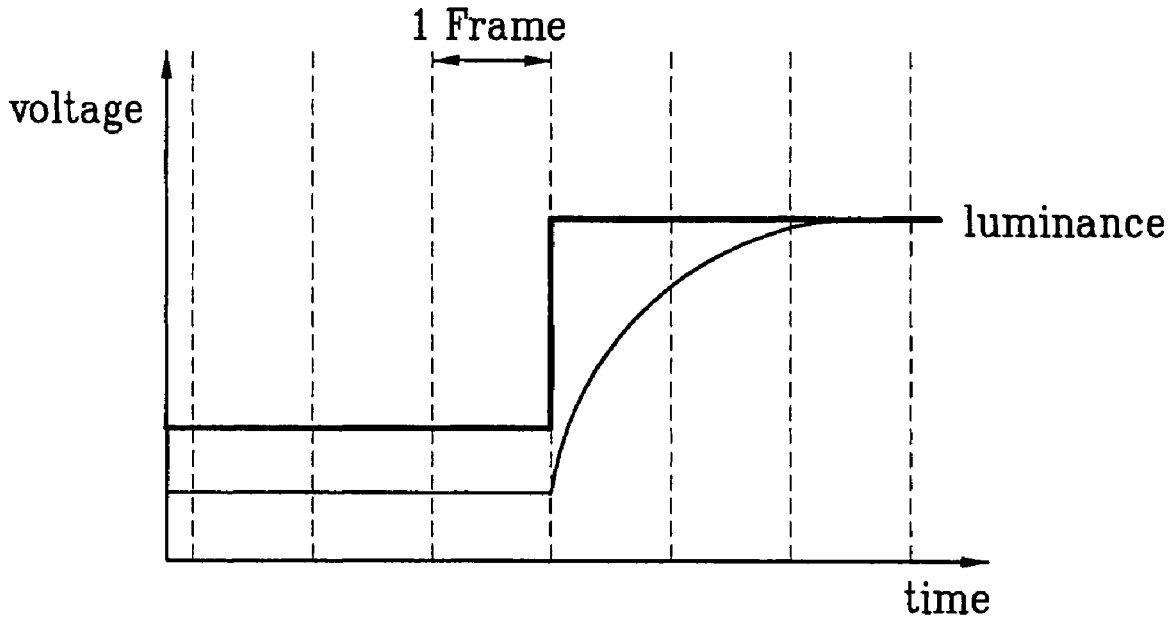
FIG. 2 illustrates a graph showing response speed and luminance of a liquid crystal cell according to the related art.
Figure 3:
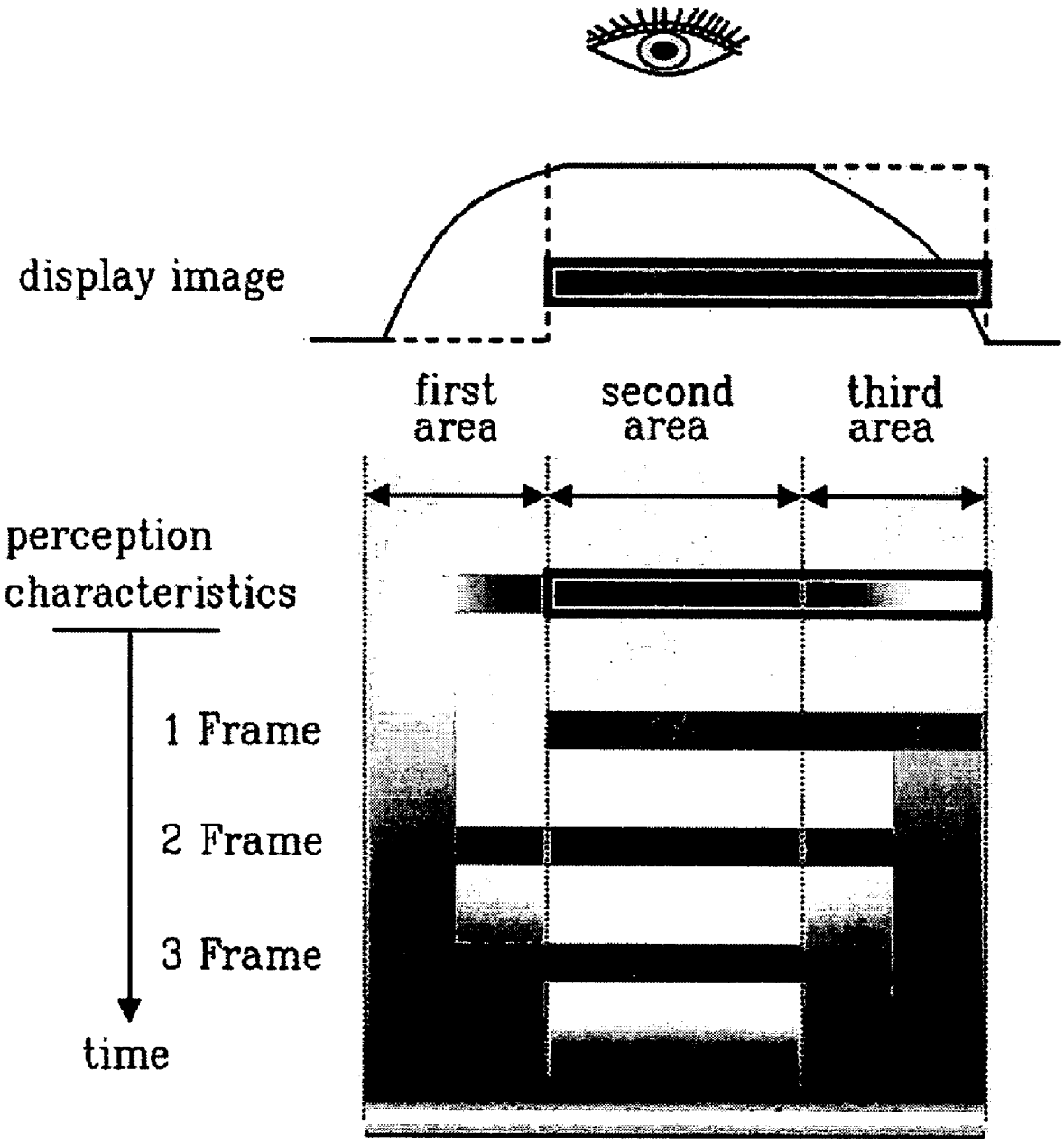
FIG. 3 illustrates a motion blurring phenomenon which is generated in an apparatus and method for driving an LCD device according to the related art.
Figure 4:
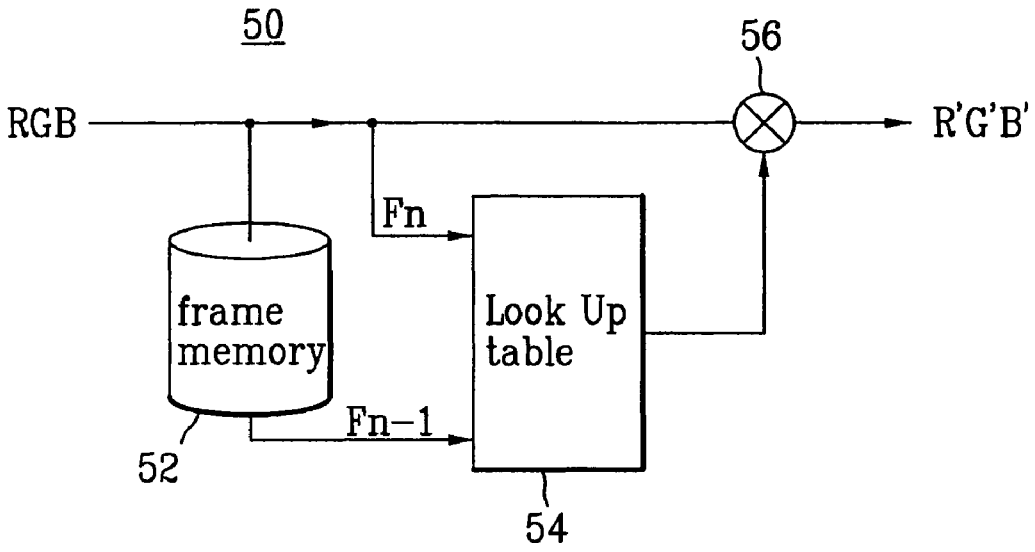
FIG. 4 is a block diagram of an over-driving apparatus according to the related art.
Figure 5:
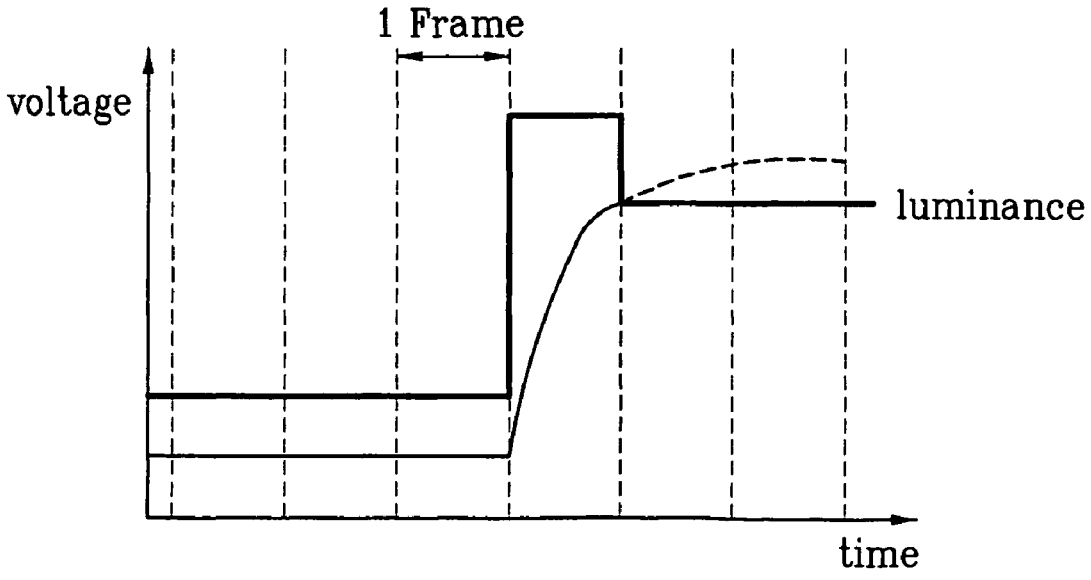
FIG. 5 illustrates a graph showing response speed and brightness of a liquid crystal cell in the over-driving apparatus.
Figure 6:
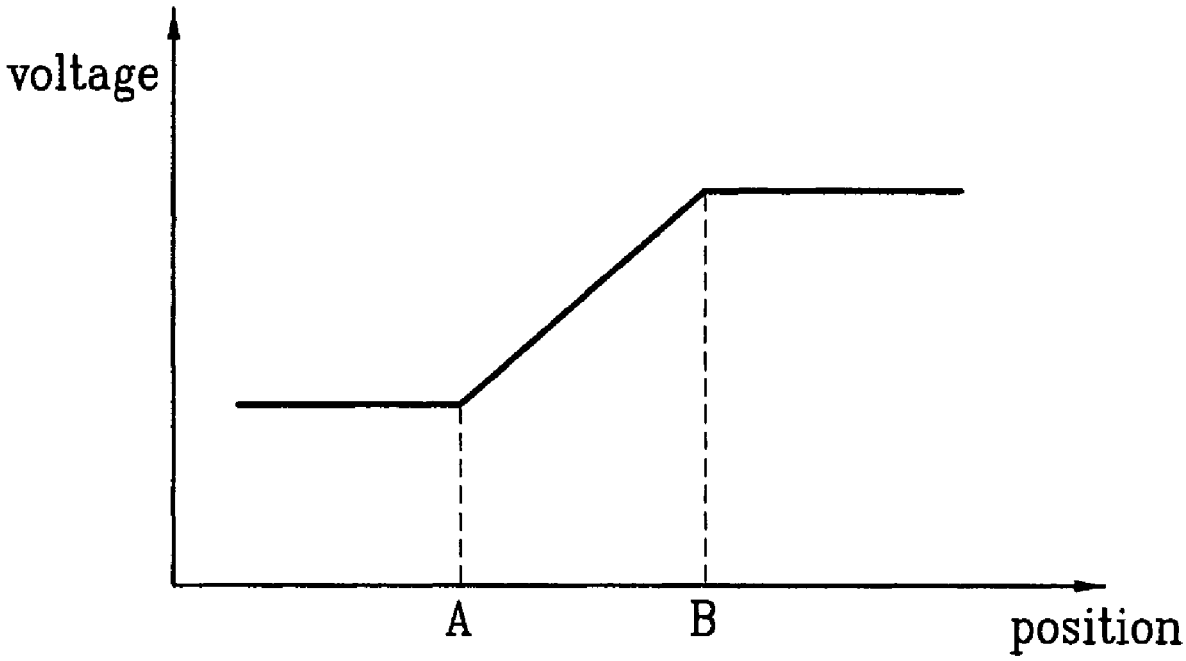
FIG. 6 illustrates boundary parts of images according to the related art.
Figure 7:
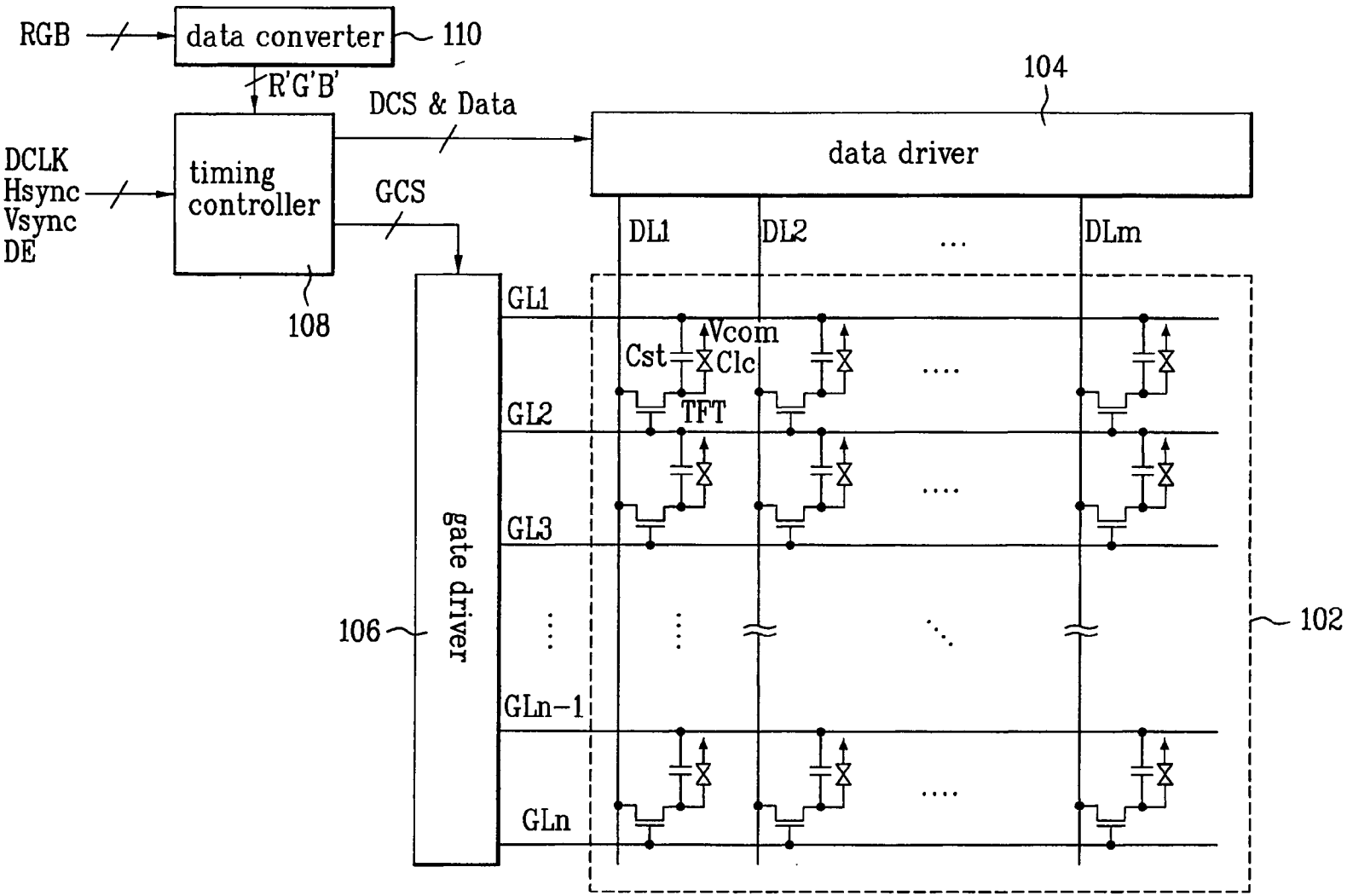
FIG. 7 illustrates an apparatus for driving an LCD device according to a first embodiment.

FIG. 7 illustrates an apparatus for driving an LCD device according to a first embodiment.

Referring to FIG. 7, the apparatus that drives an LCD device includes an image display unit 102 that includes liquid crystal cells that are formed at respective areas defined by n-th gate lines GL1 to GLn and m-th data lines DL1 to DLm. A data driver 104 that provides analog video signals to the data lines DL1 to DLm. A gate driver 106 that provides scan pulses to the gate lines GL1 to GLn. A data converter 110 that determines still images and moving images between adjacent frames of data RGB inputted from the outside, and that filters the data RGB to generate only undershoot at the boundary part of the still images, based on the determination to generate modulated data R'G'B'. A timing controller 108 that arranges the modulated data R'G'B' inputted from the data converter 110 and provides it to the data driver 104 that generates data control signals DCS that drive the data driver 104 and generates gate control signals GCS that drive the gate driver 106.

The image display unit 102 includes a transistor array substrate and a color filter array substrate, which are bound to each other in a state where they face one another. Spacers are located between two array substrates to maintain the cell gap. Liquid crystal is disposed in the space formed by the spacers between the two array substrates.

The image display unit 2 includes TFTs that are formed in areas defined by n-th gate lines GL1 to GLn and m-th data lines DL1 to DLm, and the liquid crystal cells connected to the TFTs. The TFTs respond to scan pulses from the gate lines GL1 to GLn and provide analog video signals from the data lines DL1 to DLm to the liquid crystal cells. The liquid crystal cells are composed of a common electrode and pixel electrodes connected to the TFTs, in which the common electrode and the pixel electrode face one another with respect to a liquid crystal layer. The liquid crystal cells can be described as a liquid crystal capacitor Clc in an equivalent circuit. A liquid crystal cell includes a storage capacitor Cst connected to a previous stage gate line in order to maintain an analog video signal charged in a liquid crystal capacitor Clc until the next analog video signals are charged.

The data converter 110 determines still images and moving images of data RGB using previous frame data and present frame data, which are inputted from the outside, and detects motion vectors in data of the moving images. The data converter 110 filters the data RGB to generate undershoot only at the boundary part of the still images, based on the motion vector, and generates modulated data R'G'B'. The data converter 110 provides the generated modulated data R'G'B' to the timing controller 108. The data converter 110 divides the inputted data RGB into still images and moving images, offsets a low pass effect caused by sense of view of moving image through a filtering process, and spatially modulates the inputted data RGB to generate the modulated data R'G'B'. The data converter 110 is operated not to modulate the original still images as it accentuates boundary parts in only the still images of the inputted data, but does not amplify noises in other parts of the still images except for the boundary parts.

The timing controller 108 arranges the modulated data RGB provided from the data converter 110 to comply with drive of the image display unit 102 and then provides it to the data driver 104. The timing controller 108 generates a data control signal DCS and a gate control signal GCS, using a dot clock DCLK, a data enable signal DE, and horizontal and vertical synchronous signals Hsync and Vsync, to control driving timings of the data driver 104 and the gate driver 106, respectively.

The gate driver 106 includes shift registers that sequentially generate scan pulses, or gate high pulses, in response to the gate start pulse GSP and the gate shift clock GSC in the gate control signal GCS from the timing controller 108. Such a gate driver 106 sequentially provides gate high pulses to the gate lines GL of the image display 102 to turn on the TFTs connected to the gate lines GL.

The data driver 104 converts arranged data signal Data to analog video signal, in which the arranged data signal Data is outputted from the timing controller 108 according to the data control signal DCS that is provided from the timing controller 108. The data driver 104 provides analog video signals that correspond to one horizontal line to the data lines DL each time a scan pulse is provided thereto, or each one horizontal period. The data driver 104 selects a gamma voltage that has a certain level according to gray levels of the data signal Data to generate analog video signals, and then provides the generated analog video signals to the data lines DL1 to DLm, respectively. The data driver 104 reverses the polarity of the analog video signals, which are provided to the data lines DL in response to a polarity control signal POL.

Figure 8:
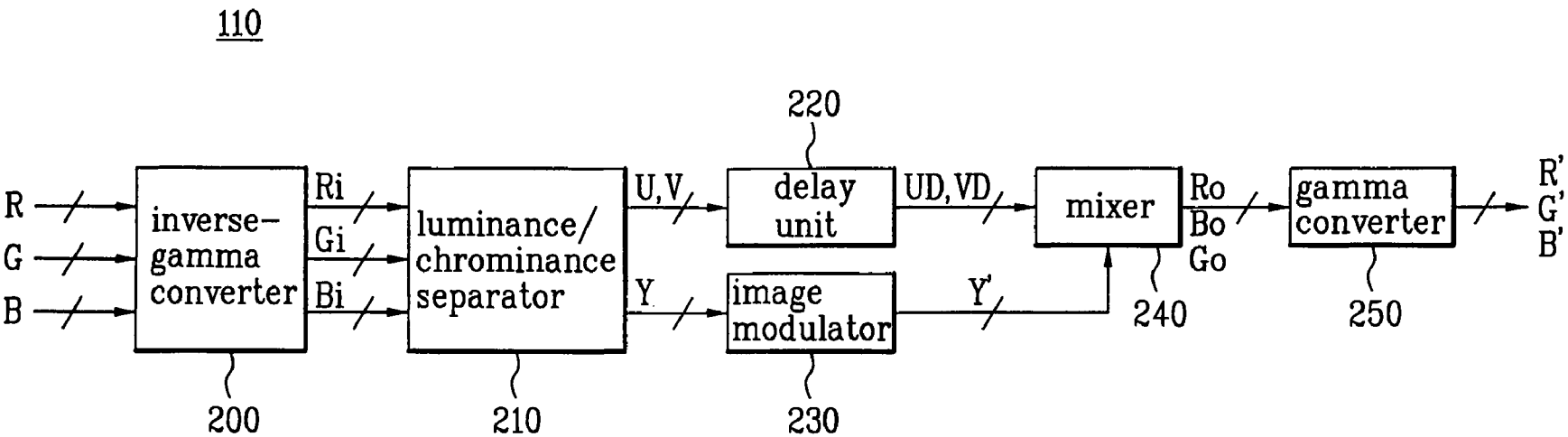
FIG. 8 is a block diagram of a data converter.

FIG. 8 is a block diagram of a data converter show in FIG. 7.

Referring to FIG. 8 along with FIG. 7, the data converter 110 includes an inverse-gamma converter 200, a luminance/chrominance separator 210, a delay unit 220, an image modulator 230, a mixer 240, and a gamma converter 250.

The inverse-gamma converter 200 performs a linear transformation of the data RGB into first data Ri, Gi and Bi, using the following equation (1), in which the data (RGB) that is inputted from the outside is a signal processed by gamma correction in consideration of output characteristics of a cathode ray tube $$Ri=R^{\lambda}$$

$$Gi=G^{\lambda}$$

$$Bi=B^{\lambda} \quad (1)$$

The luminance/chrominance separator 210 divides the first data Ri, Gi and Bi into a luminance component Y and chrominance components U and V. The luminance component Y and the chrominance components U and V can be acquired by the following equation (2) to (4).

$$Y=0.229\times Ri+0.587\times Gi+0.114\times Bi \quad (2)$$

$$U=0.493\times(Bi-Y) \quad (3)$$

$$V=0.887\times(Ri-Y) \quad (4)$$

The luminance/chrominance separator 210 provides the luminance component Y and the chrominance components U and V, which are separated from the first data Ri, Gi and Bi through equations (2) to (4), to the image modulator 230, respectively.

The image modulator 230 determines still images and moving images using the luminance components for the previous frame data and a present frame data, which are provided from the luminance/chrominance separator 210, and detects motion vectors from the moving images. The image modulator 230 filters the data RGB such that undershoot can be generated at the boundary part of the still images according to the motion vector, and provides the modulated luminance component Y' to the mixer 240.

The delay unit 220 delays the chrominance components U and V based on frame units to generate delayed chrominance components UD and VD, while the image modulator 230 filters the luminance component Y based on frame units. The delay unit 220 provides the delayed chrominance components UD and VD to the mixer 240. The delayed chrominance components UD and VD are synchronized with the modulated luminance component Y'.

The mixer 240 mixes the modulated luminance component Y' provided from the image modulator 230 with the chrominance components UD and VD provided from the delay unit 220 to generate second data Ro, Go and Bo. The second data Ro, Go and Bo are obtained from the following equations (5) to (7).

$$Ro=Y'+0.000\times UD+1.140\times VD \quad (5)$$

$$Go=Y'-0.396\times UD-0.581\times VD \quad (6)$$

$$Bo=Y'+2.029\times UD+0.000\times VD \quad (7)$$

The gamma converter 250 performs gamma correction to convert the second data Ro, Go and Bo to the modulated data R'G'B' according to the following equation (8), in which the second data Ro, Go and Bo are provided from the mixer 240.

$$R'=(Ro)^{1/\lambda}$$

$$G'=(Go)^{1/\lambda}$$

$$B'=(Bo)^{1/\lambda} \quad (8)$$

The gamma converter 250 performs gamma correction to convert the second data Ro, Go and Bo to the modulated data R'G'B' that complies with a drive circuit of the image display unit 102, using the look up table, and then provides the gamma correction result to the timing controller 108.

The data converter 110 determines still images and moving images between adjacent frames of the data inputted from the outside, filters the luminance component Y such that undershoot can be generated at the boundary part of the still images, and modulates the images. Therefore, the motion blurring phenomenon that is generated at the boundary part of the moving direction of the still images can be prevented.

Figure 9:
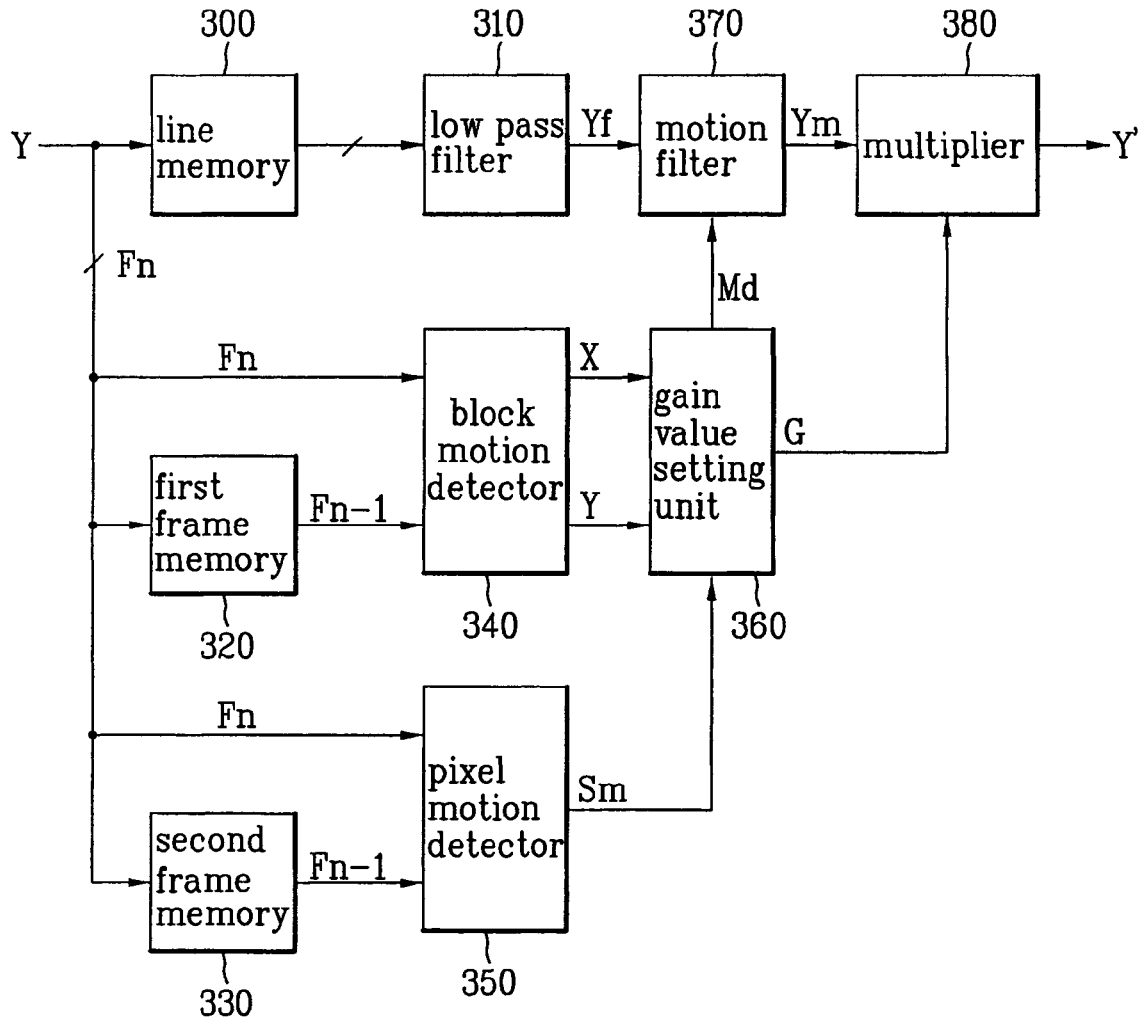
FIG. 9 is a block diagram of an image modulator.

FIG. 9 is a block diagram of an image modulator show in FIG. 8.

Referring to FIG. 9 along with FIG. 8, the image modulator 230 includes a line memory 300, a low pass filter 310, first and second frame memories 320 and 330, a block motion detector 340, a pixel motion detector 350, a gain value setting unit 360, a motion filter 370, and a multiplier 380.

The line memory unit 300 stores the luminance component based on at least 3 horizontal line units, using at least 3 line memories each of which stores a luminance component based on one horizontal line unit, in which the luminance component is provided from the luminance/chrominance separator 210. The line memory unit 300 provides the luminance component Y that is based on i×i block units (i is a positive integer greater than 3) to the low pass filter 310.

The low pass filter 310 receives the luminance component that is based on i×i block units from the line memory unit and performs low pass filtering for the luminance component and provides the signal to the motion filter 370. The low pass filter 310 widely expends dispersion size of Gaussian distribution for the luminance component Y based on i×i block units using the luminance component Y based on i×i block units. Therefore, the luminance component Y that is filtered by the low pass filter 310, makes images smooth.

The first and second frame memories 320 and 330 store luminance components based on frame units, in which the luminance components are provided from the luminance/chrominance separator 210.

The block motion detector 340 compares luminance component Y of a present frame Fn, which is provided from the luminance/chrominance separator 210, with luminance component Y of a previous frame Fn−1, which is provided from the first frame memory 320, based on i×i block units, to detect the motion vectors X and Y that include X-axis and Y-axis displacements for motion, based on i×i block units.

The pixel motion detector 350 compares the luminance component Y of the present frame Fn, which is provided from the luminance/chrominance separator 210, with the luminance component Y of the previous frame Fn−1, which is provided from the second memory 330, based on pixel units, to generate a motion signals Sm of the pixel units and to provide the motion signals Sm to the gain value setting unit 360. The motion signals Sm is in a first logic state (High) when there is a movement between the present invention frame Fn and the previous frame Fn−1. Otherwise it is in a second logic state (Low).

The gain value setting unit 360 sets a gain value G that sets motion speed using the motion vectors X and Y from the block motion detector 340 and the motion signals Sm from the pixel motion detector 350. The gain value setting unit 360 sets motion direction Md using the motion vectors X and Y of the block motion detector 340.

If the motion signal Sm is in the first logic state, the gain value setting unit 360 sets the gain value G in response to the motion vectors X and Y as expressed by the following equation (9) and then provides the gain value G to the motion filter 370 and the multiplier 380. Since the gain value G is determined by X-axis displacement and Y-axis displacement of motion, the larger the gain value the more the motion speed is increased.

$$G = \sqrt{X^2 + Y^2} \tag{9}$$

The gain value setting unit 360 detects motion direction Md based on i×i block units according to the X-axis and Y-axis displacements of motion when the motion signals Sm is in the first logic state, and provides the motion direction Md to the motion filter 370. The motion direction of a block unit of i×i is determined by any one of eight displacements of a moving image displayed by the previous frame Fn−1 and the current frame Fn, such as left side to right side, upper side to lower side, left upper corner to right lower corner, and left lower corner to right upper corner.

The gain value G is set to '0' when the motion signals Sm is in the second logic state, and detects the motion direction Md as '0' and provides it to the multiplier 380.

Figure 10:
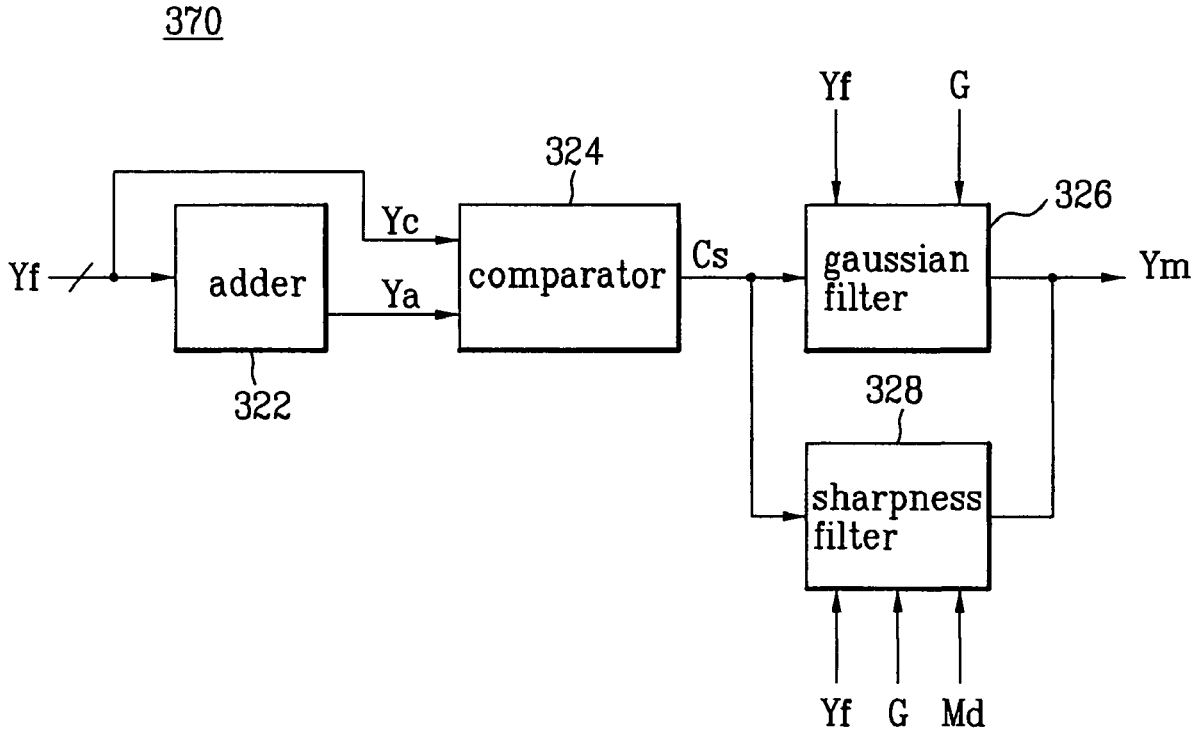
FIG. 10 is a block diagram of a motion filter.

As shown in FIG. 10, the motion filter 370 includes an adder 322, a comparator 324, a Gaussian filter 326, and a sharpness filter 328.

The adder 322 adds a luminance component Yf of peripheral regions except for the center portion of the luminance component Yf based on i×i block units, which are filtered using the low pass filter 310, and provides the added luminance component Ya to the comparator 324.

The comparator 324 compares the luminance component Yc of the center portion in a luminance component Yf based on i×i block units, which are filtered using the low pass filter 310, with the added luminance component Ya of the adder 322 to generate comparison signal Cs. The generated comparison signal Cs is provided to the Gaussian filter 326 and the sharpness filter 328. The comparison signal Cs is in a first logic state (High) when the luminance component Yc of the center portion is greater than the added luminance component Ya. Otherwise, the comparison signal Cs is in a second logic state (Low).

The Gaussian filter 326 filters such that summation of a luminance component Yf based on i×i block units is '1', in which the luminance component Yf is processed by low pass filtering in the low pass filter 310, according to the Gain value G provided from the gain value setting unit 360, when the comparison signal Cs from the comparator 324 is in the first logic state. The Gaussian filter 326 provides the filtered result to the multiplier 380. Therefore, the Gaussian filter 326 filters the luminance component based on i×i block units to minimize overshoot generated in the luminance component Yf based on i×i block units, such that the filter result is smooth.

The sharpness filter 328 filters such that summation of a luminance component Yf based on i×i blocks unit is '0', in which the luminance component Yf is filtered using the low pass filter 310, according to the Gain value G provided from the gain value setting unit 360 and a motion direction Md, when the comparison signal Cs from the comparator 324 is in the second logic state. The Gaussian filter 326 provides the filtering result to the multiplier 380. The summation of the luminance component Ym based on i×i block units, which is filtered in the sharpness filter 328, is '0', because the luminance component at the center portion has a value (+), which is greater than that of the luminance component at the peripheral portion of the center portion, but the luminance component at the peripheral portion has a value (−), which is less than that of the luminance component at the center portion. Therefore, the sharpness filter 328 filters the luminance component Yf based on i×i block units such that overshoot is generated in the luminance component Yf based on i×i block units according to the gain value G and the motion direction Md.

The motion filter 370 filters the luminance component Yf based on i×i block units, which is filtered by the low pass filter 310 such that undershoot can be generated at the boundary part of the still images and the moving images according to the motion speed Ms from the block motion detector 340 and overshoot can be minimized therein.

The multiplier 380 multiplies a luminance component Ym that is filtered in the motion filter 370 by the gain value G from the gain value setting unit 360 to generate modulated luminance component Y', and then provides the modulated luminance component Y' to the mixer 240. Therefore, the magnitude of the undershoot of the modulated luminance component Y' is adjusted according to the gain value G, in which the undershoot is generated at the boundary part of the still images and the moving images.

Figure 11A:
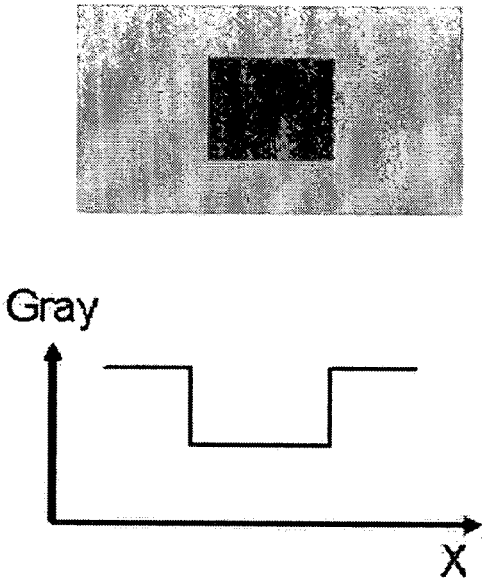
FIG. 11A illustrates a luminance component of original images.
Figure 11B:
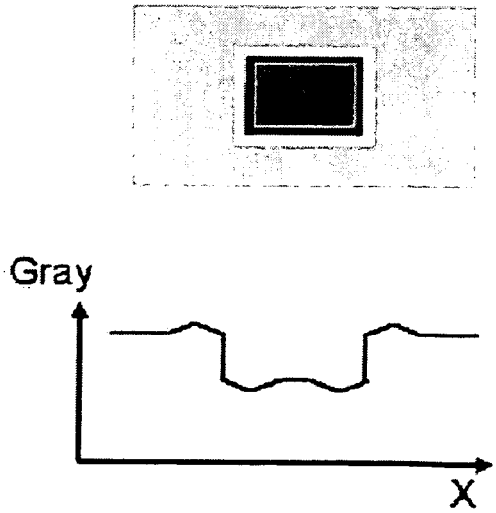
FIG. 11B illustrates overshoot and undershoot when luminance component of original images are entirely processed by sharpness filtering.
Figure 12A:
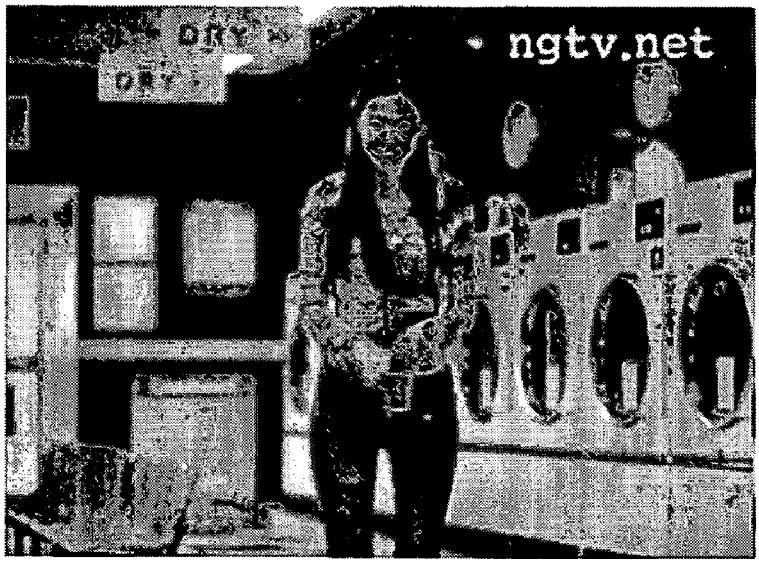
FIG. 12A illustrates a picture of an original image.
Figure 12B:
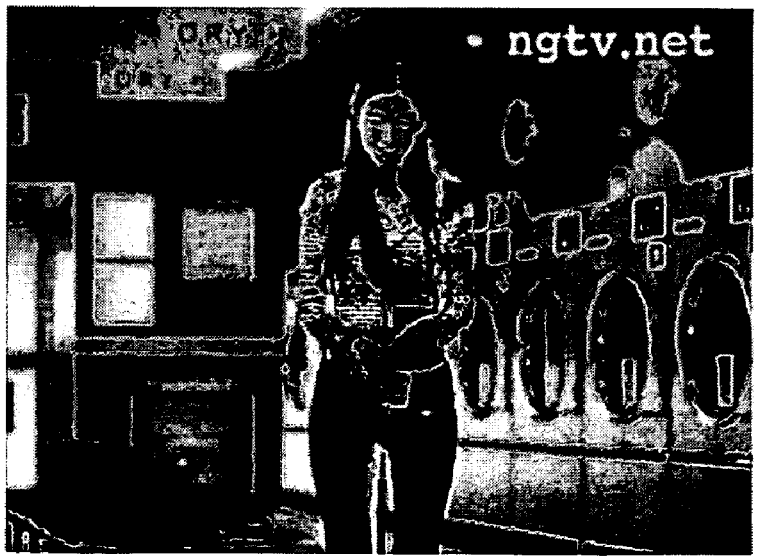
FIG. 12B illustrates a picture of the original image whose luminance component is entirely processed by sharpness filtering.

When all luminance components Y of original images are processed by the sharpness filtering, undershoot (black portion) and overshoot (white portion) as shown in FIG. 11B are generated in all boundary parts of the still images and the moving images of the original images of FIG. 11A. Therefore, a motion blurring phenomenon occurs in the original images, such as a picture of FIG. 12A, due to overshoot (white portion) which is generated in the boundary parts of the still images and moving images, such as a picture of FIG. 12B. The overshoot generates the motion blurring phenomenon in the original images due to sensitive activity of user's eyes and a flicker effect.

Figure 13A:
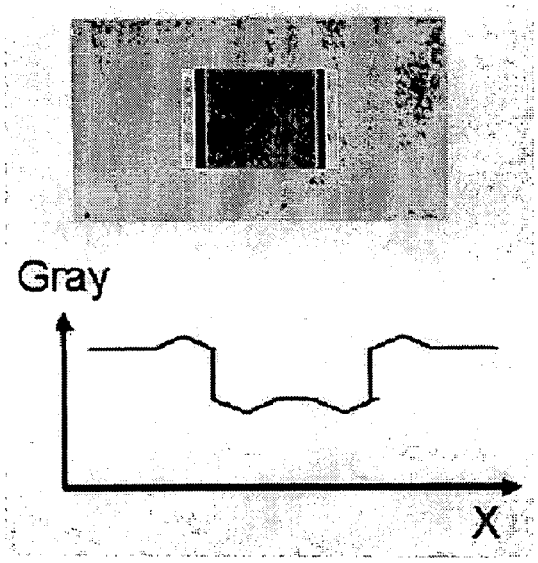
FIG. 13A illustrates a picture and a graph that describe overshoot and undershoot when only moving images in the original images are processed by sharpness filtering.
Figure 13B:
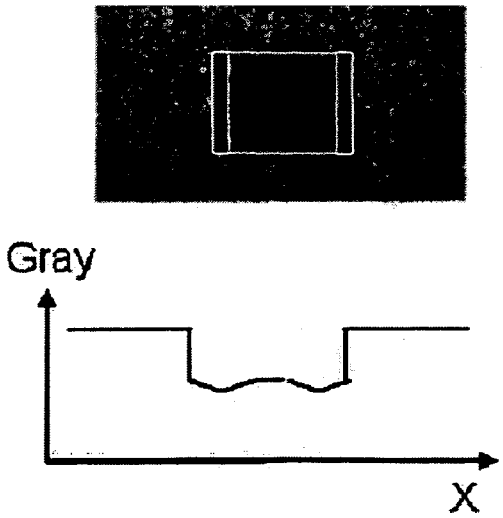
FIG. 13B illustrates a picture and a graph that describes an image when only moving images in the original images are processed by sharpness filtering.
Figure 14A:
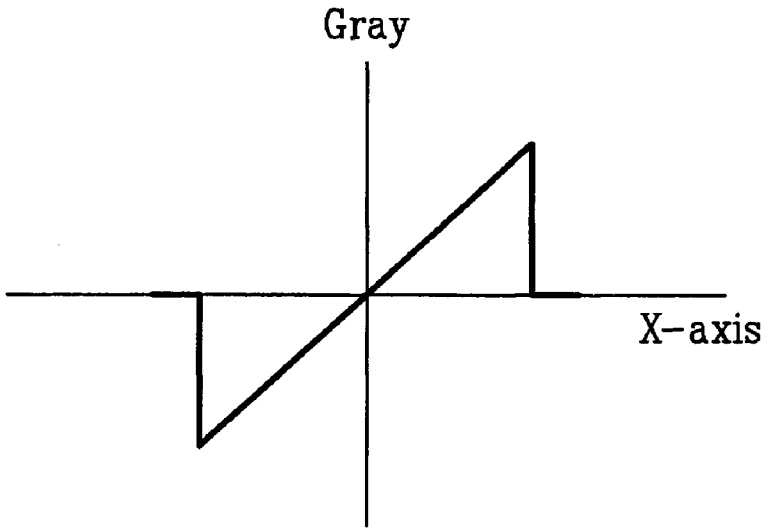
FIG. 14A illustrates a waveform of luminance component at the boundary part of still images and moving images of the original images.
Figure 14B:
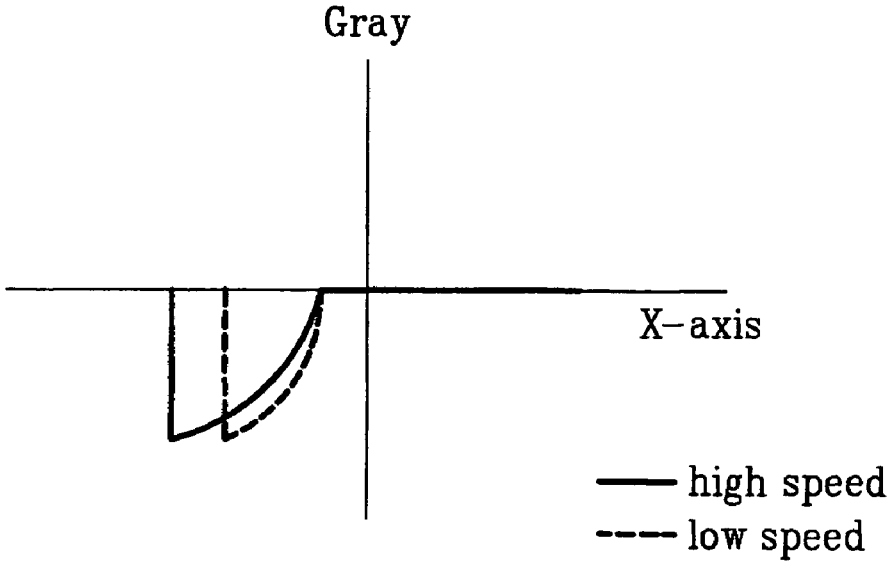
FIG. 14B illustrates a waveform that shows the magnitude of undershoot that is generated at the boundary part of still images and moving images according to gain depending on a motion speed.

The image modulator 230 modulates the luminance component Y such that only undershoot appears at the boundary part of the still images and the moving images are clearly outlined, with black lines, at the boundary parts, except for overshoot (white portion) at the boundary part which is sensitive to viewer perception. For example, as shown in FIG. 13A, the luminance component Y of the original images is modulated, as the luminance component Y of images processed by a sharpness filtering is modulated such that only undershoot can be generated at the boundary part of the still images and the moving images, as shown in FIG. 13B. The boundary parts of the still images and the moving images as shown in FIG. 14A set their undershoot sizes according to motion speed Ms of the moving images as shown in FIG. 14B. When the motion speed Ms of the moving images is more than 3 pixels based on frame units, the undershoot sizes appears relatively wide. When the motion speed Ms of the moving images is less than 3 pixels based on frame units, the undershoot sizes appears relatively small.

Figure 15A:
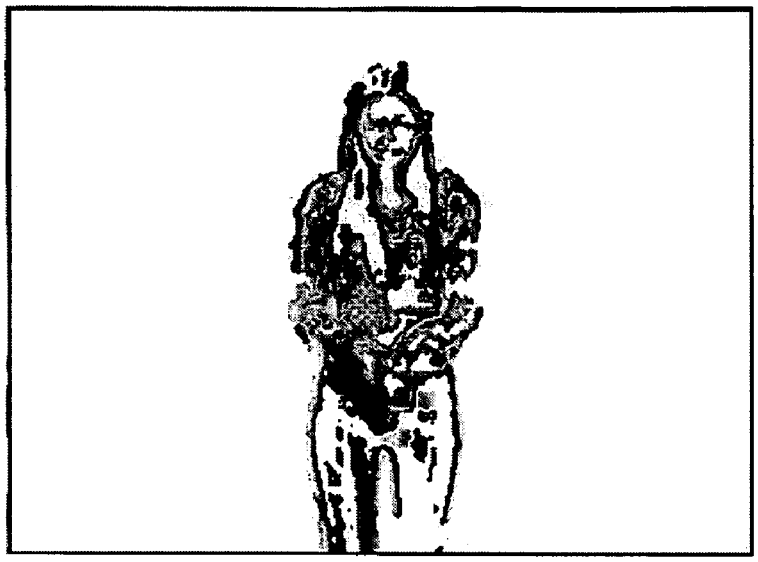
FIG. 15A illustrates a picture that shows moving images detected in the original images.
Figure 15B:
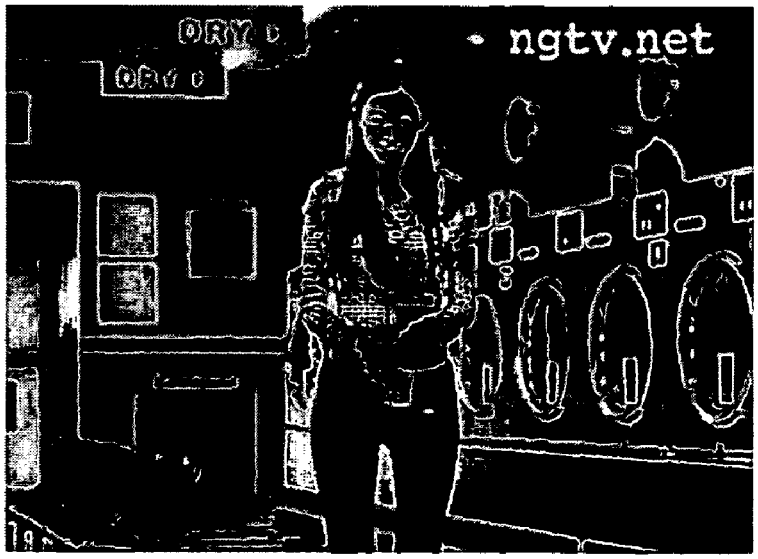
FIG. 15B illustrates a picture that shows images that are filtered such that undershoot is only generated at the boundary parts of still images and moving images.

The LCD driving apparatus detects movement of moving images as shown in FIG. 15A, and performs a sharpness filtering based on gain value G according to the detected motion speed Ms and motion direction Md to modulate a luminance component Y such that only undershoot can be generated in the boundary parts of the still images and the moving images. Since the still images and the moving images are naturally divided and the moving images are clearly shown, the present embodiment can implement stereoscopic moving images.

Figure 16:
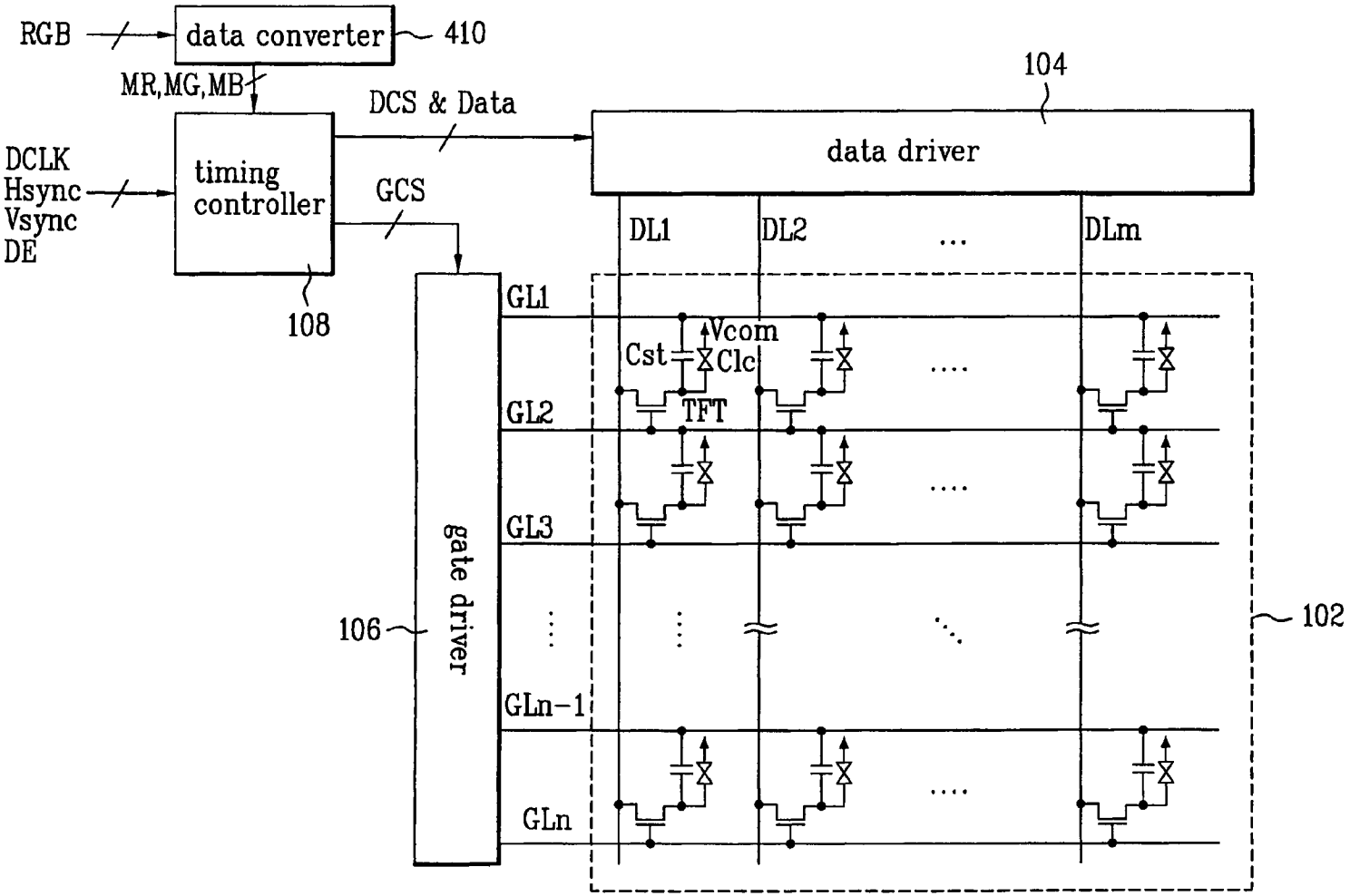
FIG. 16 illustrates an apparatus that drives an LCD device according to a second embodiment of the present invention.

FIG. 16 illustrates an apparatus for driving an LCD device according to a second embodiment of the present invention.

Referring to FIG. 16, the apparatus that drives an LCD device includes an image display unit 102 that includes liquid crystal cells that are formed at respective areas defined by n-th gate lines GL1 to GLn and m-th data lines DL1 to DLm. A data driver 104 provides analog video signals to the data lines DL1 to DLm. A gate driver 106 provides scan pulses to the gate lines GL1 to GLn. A data converter 410 determines still images and moving images between adjacent frames of data RGB inputted from the outside, that filter the data RGB to generate only undershoot at the boundary part of the still images, based on the determination to generate a first modulated data R'G'B' and that modulate the first modulated data R'G'B' to generate a second modulated data MR, MG and MB such that liquid crystal response speed is rapid. A timing controller 108 arranges the second modulated data R'G'B' inputted from the data converter 410 to provide it to the data driver 104, and generates data control signals DCS that drive the data driver 104, and generate gate control signals GCS that drive the gate driver 106.

As shown in FIG. 16, the apparatus that drives an LCD device according to the second embodiment is identical to the first embodiment except for the data converter 410.

Figure 17:
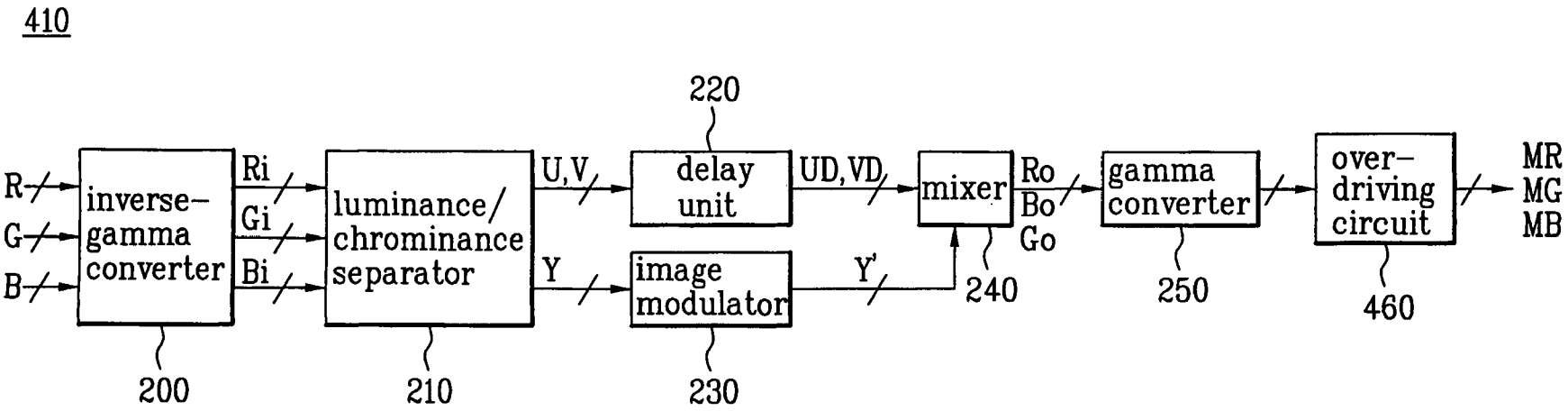
FIG. 17 illustrates a schematic block diagram of a data converter.

The data converter 410, as shown in FIG. 17, includes an inverse-gamma converter 200, a luminance/chrominance separator 210, a delay unit 220, an image modulator 230, a mixer 240, a gamma converter 250, and an over-driving circuit 460.

Figure 18:
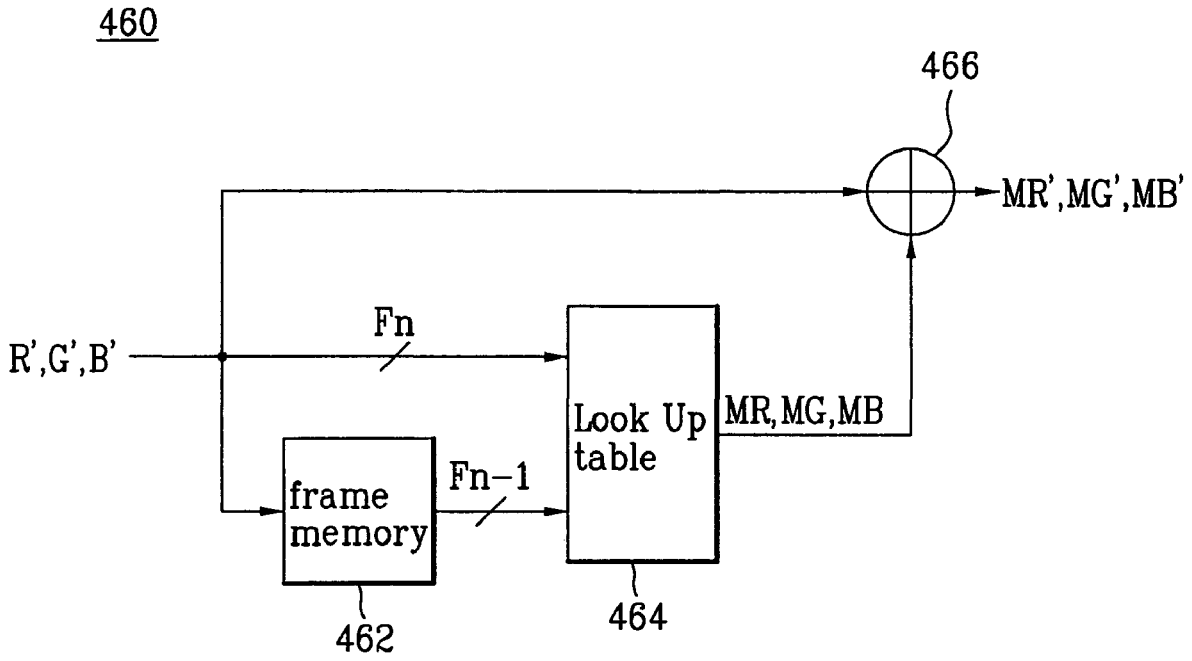
FIG. 18 illustrates a schematic block diagram of a fast speed driving circuit.

Since the data converter 410 shown in FIG. 17 is configured the same as the data converter 110 shown in FIG. 8 to FIG. 10, except for the over-driving circuit 460 of the data converter 410 shown in FIG. 18, the over-driving circuit 460 will be described in detail but a description for other identical elements will be omitted. As shown in FIG. 18, the over-driving circuit 460 includes a frame memory 462 that stores the first modulation data R'G'B' provided from the gamma converter 250. A look up table 464 compares the first modulated data R'G'B' of a present frame Fn provided from the gamma converter 250 with the first modulated data R'G'B' of a previous frame Fn−1 provided from the frame memory 462 to generate a second modulated data MR, MG and MB, such that liquid crystal response speed is rapid. A mixer mixes the second modulated data MR, MG and MB from the look up table 464 with the first modulated data R'G'B' of the present frame Fn to provide it to the timing controller 108.

The look up table 464 records the second modulated data MR, MG and MB converted to a voltage greater than that of the first modulated data R'G'B of the present frame Fn in order to enhance the liquid crystal response speed, in which the voltage corresponds to a gray level of rapidly changed images.

The mixer 466 mixes the first modulated data R'G'B'of the present frame Fn with the second modulated data MR, MG and MB and provides it to the timing controller 108.

Since the over-driving circuit 460 converts the first modulated data R'G'B' of the present frame Fn to the second modulated data MR, MG and MB using the look up table 464, and mixes the first modulated data R'G'B' with the second modulated data MR, MG and MB to enhance an liquid crystal response speed, the motion blurring phenomenon can be prevented.

As described above, the apparatus and method that drives an LCD device can implement stereoscopic moving images, as images are filtered and modulated, according to motion speed and direction of the images to generate only undershoot in the boundary parts of the still images and the moving images, and thus the still images and the moving images are naturally divided, such that the moving images are clearly shown.

The apparatus and method that drives an LCD device can remove the motion blurring phenomenon using an algorithm without any modification of panel design and hardware. In addition, clear moving images can be provided and still stereoscopic images can be provided without noise.

It will be apparent to those skilled in the art that various modifications and variations can be made without departing from the spirit or scope of the embodiments. Thus, it is intended that the present embodiments covers the modifications and variations, provided they come within the scope of the appended claims and their equivalents.

What is claimed is:

1. An apparatus that drives an LCD device comprises:

an image display unit;

a data driver;

a gate driver;

a data converter that determines still images and moving images between adjacent frames of input data and generates modulated data, wherein the modulated data generates only undershoot at a boundary part of the still images and the moving images; and a timing controller that arranges the modulated data and provides it to the data driver that drives the data driver and the gate driver.

2. The apparatus as in claim 1, wherein the image display unit includes liquid crystal cells that are formed in areas defined by a plurality of gate lines and a plurality of data lines;

wherein the data driver provides analog video signals to the data lines; and wherein the gate driver provides scan pulses to the gate lines.

3. The apparatus as in claim 1, wherein the data converter detects a motion vector of the inputted data and adjust the magnitude of the undershoot.

4. The apparatus as in claim 3, wherein the data converter includes:

an inverse-gamma converter that performs inverse gamma correction on the inputted data, which is based on frame units, to generate a first data;

a luminance/chrominance separator that separates a luminance component and chrominance components from the first data;

an image modulator that determines the still images and the moving images using a luminance component from the data of a previous frame and a luminance component from the data of a present frame, which are provided from the luminance/chrominance separator that detects a motion vector from the moving images, and filters the luminance component of the present frame such that the undershoot is generated according to the motion vector, to generate a modulated luminance component;

a mixer for mixing the modulated luminance component with the chrominance components to generate a second data; and a gamma converter for performing gamma correction for the second data to create the modulated data.

5. The apparatus as in claim 4, wherein the motion vector includes motion direction and motion speed between the adjacent frames.

6. The apparatus as in claim 5, wherein the undershoot width is adjusted according to the motion speed, and the undershoot depth is adjusted according to the motion direction.

7. The apparatus as in claim 5, wherein the image modulator includes:

a line memory unit that stores the luminance component based on at least 3 horizontal line units;

a low pass filter that receives a luminance component based on i×i block units (where i is a positive integer greater than 3) from the line memory unit and filters the luminance component based on i×i block units using a low pass filter;

a first and a second frame memories that store the luminance component, which is provided from the luminance/chrominance separator, base on frame units;

a block motion detector that compares the luminance component of a present frame, which is provided from the luminance/chrominance separator, with that of a previous frame, which is provided from the first frame memory, based on i×i block units, to detect the motion vector based on i×i block units;

a pixel motion detector that compares the luminance component of the present frame with that of the previous frame to generate motion signals of the pixel units, wherein the luminance component is provided from the second frame memory, based on pixel units;

a gain value setting unit that sets the gain and adjust intensity of the undershoot, and the motion direction, according to the motion vector and the motion signals;

a motion filter that minimizes generation of overshoot in the luminance component based on i×i block units, which is processed by low pass filtering in the low pass filter, according to the gain and the motion direction from the gain value setting unit, and generates the undershoot; and a multiplier that multiplies a luminance component filtered in the motion filter by the gain value to generate modulated luminance component and that provides the modulated luminance component to the mixer.

8. The apparatus as in claim 7, wherein the motion filter includes:

an adder that adds the luminance component of the peripheral regions except for the center portion of the luminance component based on i×i block units, which are filtered using the low pass filter;

a comparator that compares the luminance component of the center portion with the summed luminance component of the adder to generate a comparison signal;

a first filter that filters such that summation of luminance component is '1' based on the i×i block units using the gain, according to the comparison signal, to minimize the overshoot and to provide it to the multiplier; and a second filter that filters such that summation of the luminance component is '0' based on the i×i block units that use the gain and the motion direction according to the comparison signal to generate the undershoot and to provide it to the multiplier.

9. The apparatus as in claim 3, wherein the data converter includes:

an inverse-gamma converter that performs inverse gamma correction to the inputted data based on frame units to generate a first data;

a luminance/chrominance separator that separates the luminance component and chrominance components from the first data;

an image modulator that determines the still images and the moving images using luminance component of a previous frame data and luminance component of a present frame data, which are provided from the luminance/chrominance separator that detects motion vectors from the moving images, and that filters the luminance component of the present frame such that the undershoot is generated according to the motion vector, to generate a modulated luminance component;

a mixer that mixes the modulated luminance component with the chrominance components to generate a second data;

a gamma converter that performs gamma correction for the second data to create a third data; and an over-driving circuit that modulates the third data to the modulated data such that the response speed of the as liquid crystal can be increased.

10. The apparatus as in claim 9, wherein the motion vector includes motion direction and motion speed between the adjacent frames.

11. The apparatus as in claim 10, wherein the undershoot width is adjusted according to the motion speed, and the undershoot depth is adjusted according to the motion direction.

12. The apparatus as in claim 9, wherein the image modulator includes:

a line memory unit that stores the luminance component based on at least 3 horizontal line units, wherein the luminance component is provided from the luminance/chrominance separator;

a low pass filter that receives luminance component based on i×i block units (where i is a positive integer greater than 3) from the line memory unit and filters the luminance component based on i×i block units using the low pass filter;

a first and a second frame memories that store the luminance component based on frame units, wherein the luminance component is provided from the luminance/chrominance separator, a block motion detector that compares the luminance component of a present frame with that of a previous frame based on i×i block units, to detect the motion vector based on i×i block units, wherein the luminance component of a present frame is provided from the luminance/chrominance separator, and wherein the luminance component of a previous frame is provided from the first frame memory, a pixel motion detector that compares the luminance component of the present frame with that of the previous frame based on pixel units, to generate a motion signals of the pixel units, wherein the luminance component of the present frame is provided from the second frame memory;

a gain value setting unit that sets the gain to adjust intensity of the undershoot, and the motion direction, according to the motion vector and the motion signals;

a motion filter that minimizes the generation of overshoot in the luminance component based on i×i block units, which is filtered using the low pass filter, according to the gain and the motion direction from the gain value setting unit, and that generates the undershoot; and a multiplier that multiplies the luminance component that is filtered in the motion filter by the gain value to generate modulated luminance component and provides the modulated luminance component to the mixer.

13. The apparatus as in claim 12, wherein the motion filter includes:

an adder that adds a luminance component of peripheral regions except for the center portion of the luminance component based on i×i block units, which are filtered using the low pass filter;

a comparator that compares the luminance component of the center portion with the summed luminance component of the adder to generate a comparison signal;

a first filter that filters such that summation of luminance component is '1' based on the i×i block units using the gain, according to the comparison signal, to minimize the overshoot and to provide it to the multiplier; and a second filter that filters such that summation of the luminance component is '0' based on the i×i block units using the gain and the motion direction according to the comparison signal to generate the undershoot and to provide it to the multiplier.

14. The apparatus as in claim 9, wherein the over-driving circuit includes:

a frame memory that stores the third data based on frame units, wherein the third data is provided from the gamma converter; and a look up table that generates the modulated data, using the third data of a present frame, which is provided from the gamma converter, and the third data of a previous frame from the frame memory.

15. The apparatus as in claim 14, wherein the over-driving circuit further includes a mixer that mixes the modulated data from the look up table with the third data of the present frame to provide it to the timing controller.

16. A method that drives an LCD device with an image display unit that includes liquid crystal cells that are formed areas that are defined by a plurality of gate lines and a plurality of data lines, the method comprises the steps of:

determining still images and moving images between adjacent frames of input data, and generating modulated data which generates only undershoot in a boundary part of the still images and the moving images;

providing scan pulses to the respective gate lines; and converting the modulated data to analog video signals such that the signals are synchronized with the scan pulses, and providing the analog video signals to the respective data lines.

17. The method as in claim 16, wherein the act of generating modulated data includes the acts of detecting motion vector of the inputted data and adjusting magnitude of the undershoot based on the detected motion vector.

18. The method as in claim 17, wherein the act of generating modulated data includes the acts of:

performing inverse-gamma correction to the inputted data based on frame units and generate a first data;

separating luminance component and chrominance components from the first data;

determining the still images and the moving images using the luminance component of a previous frame data and luminance component of a present frame data, detecting motion vector from the moving images, and filtering the luminance component of the present frame such that the undershoot is generated according to the motion vector, to generate modulated luminance component;

mixing the modulated luminance component with the chrominance components to generate a second data; and performing gamma correction for the second data to generate the modulated data.

19. The method as in claim 18, wherein the motion vector includes motion direction and motion speed between the adjacent frames.

20. The method as in claim 19, wherein the undershoot width is adjusted according to the motion speed and the undershoot depth is adjusted according to the motion direction.

21. The method as in claim 19, wherein the act of generating the modulated luminance component includes the acts of:

storing the luminance component based on at least 3 horizontal line units in a line memory unit;

receiving luminance components based on i×i block units (where i is a positive integer greater than 3) from the line memory unit and performing low pass filtering for the luminance component based on i×i block units;

storing the luminance component based on frame units in a first and a second frame memories;

comparing luminance component of a present frame with that of a previous frame, which is provided from the first frame memory, based on i×i block units, to detect the motion vector based on i×i block units;

comparing the luminance component of the present frame with that of the previous frame, which is provided from the second memory, based on pixel units, to generate motion signals of the pixel units;

setting gain value to adjust intensity of the undershoot, and the motion direction, according to the motion vector and the motion signals;

performing filtering such that overshoot in the luminance component based on i×i block units can be minimized, in which the luminance component is processed by low pass filtering, according to the gain value and the motion direction, and the undershoot can be generated; and multiplying luminance component filtered and the gain value using a multiplier to generate modulated luminance component.

22. The method as in claim 21, wherein the act of performing filtering includes the acts of:

summing luminance components of peripheral regions except for the center portion of the luminance component based on i×i block units, which are processed by low pass filtering;

comparing the luminance component of the center portion with the summed luminance component and generate comparison signals;

performing filtering such that summation of luminance component is '1' based on i×i block units using the gain value, according to the comparison signal, to minimize the overshoot and to provide it to the multiplier; and performing filtering such that summation of the luminance component is '0' based on i×i block units using the gain value and the motion direction according to the comparison signal to generate the undershoot and to provide it to the multiplier.

23. The method as in claim 17, wherein the act of generating modulated data includes the acts of:

performing inverse-gamma correction to the inputted data based on frame units to generate a first data;

separating the luminance component and the chrominance components from the first data;

determining the still images and the moving images using the luminance component of a previous frame data and luminance component of a present frame data, detecting motion vector from the moving images, and filtering the luminance component of the present frame such that the undershoot is generated according to the motion vector, to generate modulated luminance component;

mixing the modulated luminance component with the chrominance components to generate a second data;

performing gamma correction for the second data to generate a third data; and modulating the third data to the modulated data such that the response speed of the liquid crystal can be rapid.

24. The method as in claim 23, wherein the motion vector includes motion direction and motion speed between the adjacent frames.

25. The method as in claim 24, wherein the undershoot width is adjusted according to the motion speed and the undershoot depth is adjusted according to the motion direction.

26. The method as in claim 24, wherein the act of generating modulated luminance component includes the acts of:

storing the luminance component based on at least 3 horizontal line units in a line memory unit;

receiving luminance components based on i×i block units (where i is a positive integer greater than 3) from the line memory unit and performing low pass filtering for the luminance component based on i×i block units;

storing the luminance component based on frame units in a first and a second frame memories;

comparing a luminance component of a present frame with that of a previous frame, which is provided from the first frame memory, based on i×i block units, to detect the motion vector based on i×i block units;

comparing the luminance component of the present frame with that of the previous frame, which is provided from the second memory, based on pixel units, to generate motion signals of the pixel units;

setting gain value to adjust intensity of the undershoot, and the motion direction, according to the motion vector and the motion signals;

performing filtering such that overshoot in the luminance component based on i×i block units can be minimized, wherein the luminance component is processed by low pass filtering, according to the gain value and the motion direction, and the undershoot can be generated; and multiplying luminance component filtered and the gain value using a multiplier to generate modulated luminance component.

27. The method as in claim 26, wherein the act of performing filtering includes the acts of:

summing the luminance components of peripheral regions except for the center portion of the luminance component based on i×i block units, which are processed by low pass filtering;

comparing the luminance component of the center portion with the summed luminance component to generate comparison signals;

performing filtering such that summation of luminance component is '1' based on i×i block units using the gain value, according to the comparison signal, to minimize the overshoot and to provide it to the multiplier; and performing filtering such that summation of the luminance component is '0' based on i×i block units using the gain value and the motion direction according to the comparison signal to generate the undershoot and to provide it to the multiplier.

28. The method as in claim 23, wherein the act of modulating includes the acts of:

storing the third data in the frame memory for each unit of frame; and generating the modulated data using the third data of the current frame and the third data of the previous frame supplied from the frame memory.

29. The method as in claim 28, wherein the act of generating modulated data further comprises the act of:

mixing the modulated data from the look up table with the third data of the present frame.

* * * * *